United States Patent [19]

LeBegue

[11] Patent Number: 4,953,914

[45] **Date of Patent: * Sep. 4, 1990**

[54] MINING MACHINE WITH ROOF BOLTING APPARATUS

[75] Inventor: Maurice K. LeBegue, Fairmont, W. Va.

[73] Assignee: Baker Hughes Incorporated, Houston, Tex.

[ * ] Notice: The portion of the term of this patent subsequent to Jun. 28, 2005 has been disclaimed.

[21] Appl. No.: 329,592

[22] Filed: Mar. 28, 1989

Related U.S. Application Data

[63] Continuation of Ser. No. 212,337, Jun. 27, 1988, abandoned, which is a continuation of Ser. No. 9,278, Jan. 30, 1987, Pat. No. 4,753,486, and a continuation-in-part of Ser. No. 759,329, Jul. 26, 1985, abandoned.

[51] Int. Cl.[5] ..... E21D 20/00

[52] U.S. Cl. ..... 299/11; 299/33

[58] Field of Search ..... 299/11, 12, 33, 64, 299/67, 70; 173/22; 405/259, 303

[56] References Cited

U.S. PATENT DOCUMENTS

| | | | |
|---|---|---|---|
| 3,413,035 | 11/1968 | Lockwood | 299/64 |
| 3,493,058 | 2/1970 | Zitko | 299/33 |
| 3,813,126 | 5/1974 | Rogne, Jr. et al. | 299/33 |
| 4,047,761 | 9/1977 | Coupe | 299/64 |
| 4,131,317 | 12/1978 | Jamison et al. | 299/11 X |
| 4,199,193 | 4/1980 | Damron et al. | 299/11 X |
| 4,201,270 | 5/1980 | Ribich et al. | 405/259 X |
| 4,226,476 | 10/1980 | Fairchild et al. | 299/33 X |
| 4,269,547 | 5/1981 | Harding | 405/303 |
| 4,310,197 | 1/1982 | McCracken et al. | 299/11 |
| 4,312,540 | 1/1982 | Thompson | 299/11 |
| 4,740,037 | 4/1988 | Eager et al. | 299/33 X |
| 4,753,486 | 6/1988 | LeBegue | 299/11 |
| 4,758,049 | 7/1988 | Wernigg et al. | 299/33 |

*Primary Examiner*—Jerome W. Massie
*Assistant Examiner*—Matthew Smith
*Attorney, Agent, or Firm*—Stanley J. Price, Jr.

[57] ABSTRACT

A mining machine includes a frame with a material dislodging head mounted on the end of the frame. Ground engaging tracks propel the machine within a mine along the floor of the mine to advance the dislodging head into the face of the mine to dislodge material therefrom. Roof bolting apparatus is employed for installing roof bolts at predetermined locations in the roof of the mine above the mining machine. The roof bolting apparatus is supported by a drill pit which is positioned within the frame and movable relative to the frame. The roof bolting apparatus is arranged to install roof bolts at predetermined locations above the mining machine while the mining machine is being propelled through the mine to dislodge material from the mine face.

15 Claims, 6 Drawing Sheets

MINING MACHINE WITH ROOF BOLTING APPARATUS

CROSS REFERENCE TO RELATED APPLICATIONS

This application is a continuation of copending application Ser. No. 212,337, filed Jun. 27, 1988, now abandoned; a continuation of Ser. No. 009,278, filed on Jan. 30, 1987, entitled "MINING MACHINE WITH ROOF BOLTING APPARATUS" now U.S. Pat. No. 4,753,486; a continuation-in-part of Ser. No. 759,329 filed Jul. 26, 1985, now abandoned.

BACKGROUND OF THE INVENTION

1. Field of the Invention

This invention relates to a mining machine, and more particularly, to a mining machine which includes roof bolting apparatus which enables a plurality of roof bolts to be installed in a mine roof at predetermined locations above the mining machine while the mining machine is continually advancing into a face of the mine to remove material therefrom.

2. Description of the Prior Art

In continuous underground mining, mining machines dislodge material from a mine face and convey the dislodged material rearwardly to a receiver. The mining machine is designed to continuously advance and dislodge the material being mined, thus forming an entry or tunnel in the seam. It is not uncommon for the mining operation to be stopped at various times and the mining machine withdrawn from the entry in order to install roof supports.

Various types of roof bolters may be utilized for movement into the entry adjacent the mine face for installation of roof bolts. U.S. Pat. No. 2,771,273 discloses such a simple, portable roof drilling and bolting machine which could be used for this purpose. More recent mine roof bolting apparatus, such as those disclosed in U.S. Pat. Nos. 4,094,158 and 4,097,854, include a temporary roof support to insure the stability of the roof during installation of the roof bolts. U.S. Pat. No. 4,094,158 also includes a protective canopy to protect mine personnel during the roof bolting operation. U.S. Pat. No. 3,964,265 discloses a more sophisticated roof supporting apparatus for a roof drilling machine which includes a boom for positioning the drill against the roof. Similarly, U.S. Pat. Nos. 4,398,850 and 4,420,277 disclose portable mine roof drilling and bolting apparatus which include extensible and movable boom devices for directing the drilling and bolting member to a desired location on the mine roof.

While these and any number of other such portable roof drilling and bolting apparatus may be utilized to secure the roof above a mining area, they all require the mining machine to be temporarily moved during their operation. After the roof bolts are set, the roof drilling and bolting apparatus is withdrawn from the entry and the continuous mining machine is again moved into the entry into a position adjacent the mine face. The mining machine then continues to dislodge material until it exposes a section of unsupported roof. The mining operation is again interrupted while roof bolts are set in this section of unsupported roof. Clearly, any such interruption of the continuous mining operation does not utilize the capabilities of the continuous mining machine.

U.S. Pat. No. 3,268,258 discloses a surge device that is positioned behind a continuous miner having roof bolters mounted on the sides thereof. The surge device is moved under the tail conveyor of the mining machine a sufficient distance to allow the mining machine to continue to advance while the surge device remains stationary and the roof bolters set bolts in the roof. The surge device is then advanced to its original position under the tall conveyor of the mining machine. However, it is neither taught nor suggested that the surge device maybe used to install roof bolts over the mining machine in an area that would tend to provide protection for the mining machine operator.

U.S. Pat. No. 3,493,058 discloses a roof drilling and bolting machine which is mounted on the side of a continuous mining machine. The roof bolter assembly includes a carriage with a bolter mast, a roof jack and a floor jack mounted thereon. The roof jack and the floor jack are arranged to provide temporary support between the roof and floor of the mine and to lock the bolter carriage in a fixed position during installation of the roof bolts. Since it is mounted on the side of the machine for limited relative longitudinal movement between the machine and the bolter assembly, the bolter assembly remains stationary during installation of the roof bolts as the mining machine continues to dislodge material at the mine face. However, even though U.S. Pat. No. 3,493,058 discloses a system which improves the condition of a mine roof at either side of a continuous mining machine as it advances through the mine, there is no provision for supporting or improving the reliability of the roof directly above the mining machine as it continues to operate.

Another prior art mining machine has a T-shaped frame with ground engaging traction means located centrally of the frame and appears to be used in conjuction with a surge vehicle at the narrow, rear end thereof. The wider, forward end supports a drum type mining head which dislodges material from the face of the mine. The dislodged material is collected and transported rearwardly by a conveyor which passes over the ground engaging traction means to the surge vehicle. Roof bolting modules are located outwardly of the frame at opposite sides of the ground engaging traction means and appear to allow some roof bolts to be installed in the roof rearwardly of the drum type mining head.

Many prior art mining machines employ some type of material gathering device positioned rearwardly of and below the material dislodging head. U.S. Pat. No. 2,613,800 discloses a material gathering device in which dislodged material which is gathered at the forward end of the machine is directed by rotating or oscillating arms onto a longitudinal conveyor means located centrally of the machine for transportation of the material rearwardly of the machine. While the longitudinal conveyor means of U.S. Pat. No. 2,613,800 is of a type which is generally referred to as a "universal" chain conveyor in the mining art, the mining machine disclosed U.S. Pat. No. 3,892,443 employs a short, longitudinally extending mat chain conveyor belt.

One prior art mining machine includes a boring head located on the extended end of a long, movable boom. A large gathering platform positioned below the boring head has a plurality of gathering arms which revolve around the upper surface thereof. The arms move transversely during a portion of each revolution around the gathering platform to deposit material onto a longitudinal conveyor at the side of the machine. However, since the large gathering platform requires more longitudinal space at the forward end of the machine than other types of gathering systems, it appears to be too large and to require the length of the machine to be increased too much to be a generally accepted alternative for use in many other types of mining machines.

Accordingly, there remains a need for a mining machine which includes roof bolting apparatus which is capable of installing a plurality of roof bolts at predetermined locations in a mine roof above the mining machine while the mining machine is continually advancing into a face of the mine to remove material therefrom.

SUMMARY OF THE INVENTION

In accordance with the present invention, there is provided a mining machine including a frame with dislodging means mounted on one end of the frame. Propelling means propels the machine within a mine along the floor of the mine to advance the dislodging means into a face of the mine to dislodge material therefrom. Roof bolting means is included for installing roof bolts at predetermined locations in the roof of the mine above the mining machine. Support means for supporting the roof bolting means is positioned within the frame and movable relative to the frame. The roof bolting means is arranged to install the roof bolts at predetermined locations above the mining machine while the mining machine is advancing to dislodge material from the face of the mine.

Further, in accordance with the present invention, there is provided a mining machine including a frame with dislodging means mounted on one end of the frame. Propelling means propels the machine within a mine along the floor of the mine to advance the dislodging means into a face of the mine to dislodge material therefrom. A transverse conveyor means is mounted on the frame rearwardly of and below the dislodging means for gathering the material dislodged thereby. A longitudinal conveyor means is mounted on the frame and extends from the transverse conveyor means rearwardly of the machine to receive the material from the transverse conveyor means and to transport the material to a location rearwardly of the machine.

Still further, in accordance with the present invention, there is provided a mining machine including a frame with dislodging means mounted on one end of the frame. Propelling means propels the machine within a mine along the floor of the mine to advance the dislodging means into a face of the mine to dislodge material therefrom. Ventiliation curtain means extends veritcally and transversely of the machine at a location rearwardly of the dislodging means to provide a transverse space therebetween. There is means for inducing a flow of air transversely through the space and means for withdrawing the air from one end of the space to be discharged at an area remote from the face of the mine.

Also, in accordance with the present invention, there is provided a mining machine including a frame with a pair of oppositely rotating boring heads mounted on one end of the frame. Propelling means propels the machine within a mine along the floor of the mine to advance the boring heads into a face of the mine to dislodge material therefrom. The boring heads deposit the material dislodged thereby centrally of the frame at the one end thereof. A longitudinal conveyor means is mounted on the frame and extends centrally through the machine to collect the material at the one end of the frame and to transport the material to a location rearwardly of the machine. Ventilating means mounted on the frame rearwardly of the boring heads and above the longitudinal conveyor means exhausts air from the space between the boring heads and the ventillating means through exhaust tubing which extends longitudinally of the machine above the longitudinal conveyor means.

Further, in accordance with the present invention, there is provided a mining machine including a frame with dislodging means mounted on one end of the frame. Propelling means propels the machine within a mine along the floor of the mine to advance the dislodging means into a face of the mine to dislodge material therefrom. Roof bolting means is included for installing roof bolts at predetermined locations in the roof of the mine above the mining machine. Support means for supporting the roof bolting means is positioned within the frame and movable relative to the frame. The roof bolting means is arranged to install roof bolts at predetermined locations above the mining machine while the mining machine is dislodging material from the face of the mine. A transverse conveyor means is mounted on the frame rearwardly of and below the dislodging means for gathering material dislodged thereby. A longitudinal conveyor means is mounted on the frame and extends from the transverse conveyor means rearwardly of the machine to receive the material from the transverse conveyor means and to transport material to a location rearwardly of the machine.

Still further, in accordance with the present invention, there is provided a mining machine which includes a frame having dislodging means mounted on one end of the frame. Propelling means propels the machine within a mine along the floor of the mine to advance the dislodging means into a face of the mine to dislodge material therefrom. Support means is provided for supporting a roof bolting assembly. The support means is positioned entirely within the frame between frame longitudinal side members. The support means is movably connected to the frame longitudinal side members to permit the support means to be maintained in fixed position while the mining machine advances. Roof bolting means is positioned on the support means and is arranged to install roof bolts at predetermined locations above the mining machine while the mining machine is dislodging material from the face of the mine. A longitudinal conveyor is connected to the frame of the mining machine and is positioned between the frame longitudinal side members. The longitudinal conveyor receives material dislodged from the face of the mine by the dislodging means and transports the dislodged material to a location rearwardly of the machine.

Additionally, in accordance with the present invention, there is provided a method of mining including the step of providing a mining machine having dislodging means mounted on one end thereof. The method includes propelling the machine within a mine along the floor of the mine to advance the dislodging means into a face of the mine to dislodge material therefrom. There is also included the step of installing roof bolt means in a roof of the mine above the mining machine while the mining machine is dislodging material from the face of the mine.

Accordingly, it is an object of the present invention to provide a mining machine which includes roof bolting apparatus for installing roof bolts above the mining machine while the mining machine is being propelled wtihin a mine to dislodge material from the face of the mine.

It is a further object of the present invention to provide a mining machine which includes a transverse conveyor positioned rearwardly of a dislodging head at one end of the machine for transversely conveying the material dislodged by the dislodging head to a longitudinal conveyor for continued transportation of the material to a location rearwardly of the machine.

It is another object of the present invention to provide a mining machine which includes means for inducing air flow near the dislodging head of the machine to withdraw the air from the face of the mine to a location rearwardly of the machine.

It is a further object of the present invention to provide a mining machine which includes a frame and a support means positioned entirely within the frame for supporting a roof bolter for installing roof bolts above the mining machine while the mining machine is being propelled within a mine to dislodge material from the face of the mine.

It is yet another object of the present invention to provide a method of mining including the steps of propellin the mining machine within a mine to advance a dislodging head into a face of the mine and installing roof bolts in a roof of the mine above the mining machine during the advancement of the dislodging means into the mine face.

These and other objects of the present invention will be more completely disclosed and described in the following specification, the accompanying drawings, and the appended claims.

DESCRIPTION OF THE PREFERRED EMBODIMENTS

Figure 1:
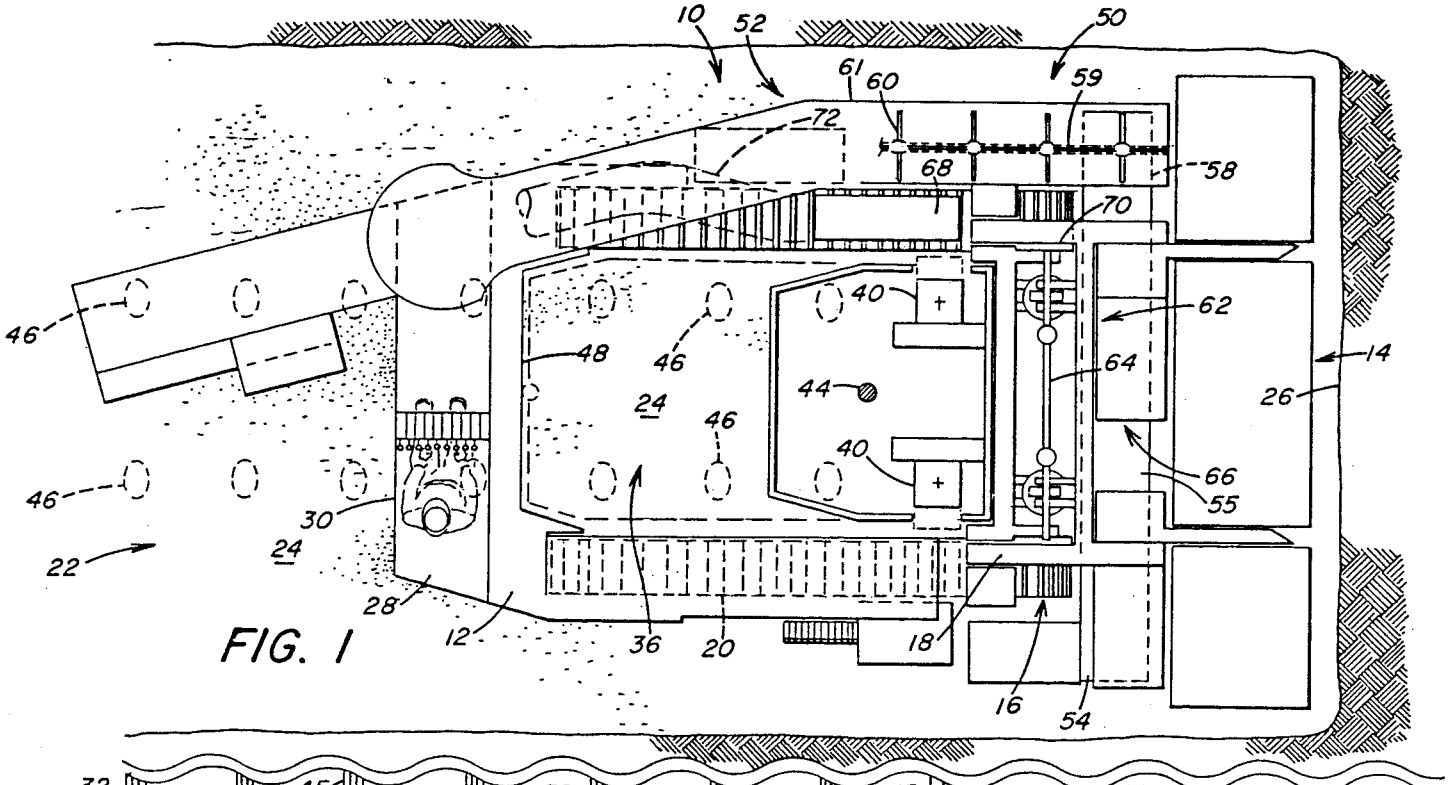
FIG. 1 is a top plan view of a mining machine including various features of the invention.
Figure 2:
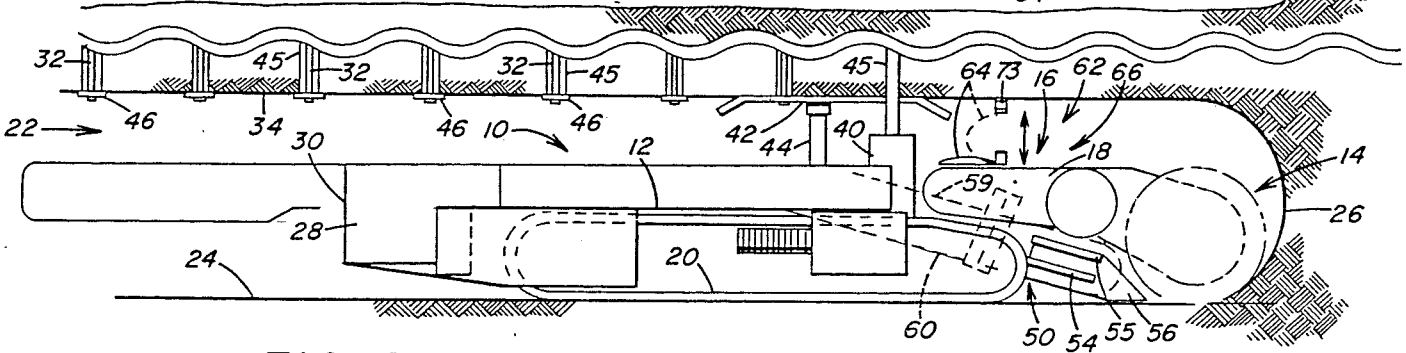
FIG. 2 is a side elevational view of the machine of FIG. 1.

Referring to the drawings and particularly to FIGS. 1 and 2, there is illustrated a mining machine 10 which includes a frame 12 and a dislodging means in the form of a drum type head 14 mounted on a forward end 16 thereof. The drum head 14 is mounted on a movable boom 18. The mining machine 10 includes ground engaging traction means 20 at each side thereof for propelling the frame 12 and the machine 10 within a mine 22 along the floor 24 thereof to advance the drum head 14 into a face 26 of the mine 22 to dislodge material therefrom.

The mining machine 10 is capable of being operated from an operating station 28 in a manner which is similar to numerous other such machines to dislodge material from the mine face 26 and to transport it rearwardly of the rear end 30 of the machine 10. Accordingly, the mining machine 10 includes operating controls and sources of power for operating the ground engaging means 20, the drum head 14 and other equipment thereon which are well-known in the art.

However, in order to provide a means for installing roof bolts 32 at predetermined locations in a roof 34 of the mine 22 above the mining machine 10 as it continues to operate, the frame 12 is constructed in a manner to include a vertically extending opening 36 in a central region thereof. The opening 36 has a width which extends transversely of the machine 10 and a greater length which extends longitudinally of the machine 10. Means for installing roof bolts is provided by a "floating" drill pit 38 which is located in the opening 36. Drill pit 38 includes a pair of bolters 40 at each side thereof. Although shown in a forward position, the drill pit 38 rests on the ground or floor 24 in the opening 36 and is capable of moving longitudinally therein relative to the frame 12 of the machine 10.

Accordingly, drill pit 38 has horizontal and longitudinal cross sectional dimensions which are respectively less than corresponding horizontal and longitudinal dimensions of the opening 36. To properly anchor the drill pit 38 in position for intalling roof bolts 32, the drill pit 38 includes temporary roof supporting means 42 which can be selectively raised for engagement against the roof 34 by a plurality of hydraulically operated, extensible posts 44, only one of which is shown in FIGS. 1 and 2. With the drill pit 38 properly positioned, each bolter 40 is in a position to drill a hole 45 in the roof 34 at each location where a roof bolt 32 is to be installed. As the holes 45 are each being drilled, the bolter 40 is maintained in a fix relative location beneath the roof 34. The bolters 40 are then capable of completing the installation of each roof bolt 32 by inserting the bolt 32 in the hole 45 to be anchored therein in any number of ways which are well-known in the mining art. Each of the roof bolts 32 supports a roof plate 46 against the roof 34 of the mine 22. It should be recognized that the drill pit 38 could alternatively include bolter modules having a completely automated bolter system rather than a manual system requiring an operator to install the bolts.

Since the drill pit 38 is free to remain at a fixed position while installing roof bolts 32, the mining machine 10 is capable of continuing its advancement through the mine 22 as it moves longitudinally relative to the stationary drill pit 38. As seen in FIG. 1, with the horizontal and longitudinal dimensions of the drill pit 38 being significantly less than those of the opening 36, the drill pit 38 is capable of relative longitudinal movement within the opening 36 until the drill pit 38 is relatively relocated to the rear 48 of the opening 36. On the other hand, as seen in FIG. 1 by the array of roof plates 46 which are respectively installed with each roof bolt 32, the drill pit 38 would not be required to "move" all the way to the rear 48 of the opening 36 in order to provide this particular array. It should be apparent that the longitudinal distance between the installed pairs of roof bolts 32 and roof plates 46 would depend on a number of factors. One factor might be the condition of the roof and thus the requirement for longitudinally closely spaced bolts 32. Another factor might be the speed with which the machine 10 advances through the mine 22 and the overall time required for installing the bolts 32 as the machine continues to advance. In any case, mining machine 10 includes means for installing each of the roof bolts 32 respectively at predetermined locations in the roof 34 of the mine 22 above the mining machine 10 independently of the movement of the machine 10 by the ground engaging traction means 20.

After the bolters 40 are utilized to install roof bolts 32 at the desired locations, the temporary roof supporting means 42 is lowered to release the drill pit 38 from its fixed location relative to the mine roof 34 and the mine floor 24. The drill pit 38 is then moved forwardly to the position as generally shown in FIGS. 1 and 2 for installation of the next set of roof bolts 32. The relative forward movement of the drill pit 38 can be accomplished by numerous means well-known in the mining art. Although not shown in the Figures, these means can include hydraulically operated pistons and cylinders between the drill pit 38 and the frame 12 or some type of power cable and winch configuration which can be selectively operated for forwardly repositioning the pit 38 longitudinally within the opening 36 to the position needed to install the next set of bolts 32.

While the use of such a drill pit 38 satisfies a primary requirement of the invention by providing a means for installing roof bolts 32 above the mining machine 10, the particular location and arrangement is made possible by another improved feature of mining machine 10. As mentioned hereinabove, it is not uncommon for mining machines to include some type of material gathering device at the forward end thereof which is positioned rearwardly of and below the drum head to gather the material dislodged thereby. Normally, the material is gathered at the forward end and is directed by rotating or oscillating arms centrally of the machine to be collected on a longitudinal conveyor means which transports the material rearwardly of the machine. However, the machine 10 includes a conveying system 50 which initially conveys the material to one side 52 of the machine 10 prior to its longitudinal transportation to a location rearwardly of the machine 10. The material conveying system 50 includes a transverse collecting and conveying means 54 in the form of an endless mat chain or metal conveyor belt which extends transversely of the machine 10 and has an upper conveying surface 55 thereof which moves from the right side of the machine to the left side 52 thereof. A forward scoop 56 initially directs the material onto the upper conveying surface 55 of the endless mat chain conveyor belt 54 to allow it to transport the material transversely of the machine. The discharge end 58 of the transverse conveyor belt 54 is located at the side 52 of the machine 10 and passes beneath a longitudinal conveying means 60 in the form of a longitudinally extending "universal" endless chain conveyor. The endless chain conveyor includes a plurality of spaced flights 60 that run along the upper surface of a longitudinally extending pan 61. The discharge end 58 of the transverse conveyor belt 54 intersects the pan 61 so that the upper conveying surface 55 thereof lies in a common plane with the upper surface of the pan 61. Accordingly, the material on the upper conveying surface 55 of the conveyor 54 will be deposited between the moving flights 60 of the longitudinal conveyor 59 for further transportation rearwardly of the machine 10 for disposition in a manner which is well-known in the mining art. Material conveying system 50 eliminates the need for the longitudinal conveyor to be located centrally of the machine while allowing the material to be initially collected in a narrow space at the forward end 16 without increasing the overall length of the machine 10 as compared to other similar types of mining machine.

The machine 10 includes another feature which improves the working conditions of any personnel in the drill pit 38 and the overall atmospheric condition in the mine 22 during the operation of the machine 10. Specifically, in order to reduce the amount of air-borne particles of material produced by the mining head 14 from moving rearwardly to the locations of the various machine operators, a ventilation system 62 is provided. The ventilation system 62 includes a ventilation curtain 64 which extends vertically and transversely of the machine at a location rearwardly of the drum head 14 to provide a transverse space 66 therebetween. The ventilation curtain 64 extends for a length which equals only about half of the overall width of the entire machine 10. However, the curtain 64 is centrally located thereon to allow adequate visibility of the operators to the end portion of each drum head 14 at either side of the curtain 64 for conventional operation of the drum head 14 as it continues to dislodge material from the face 26.

In order to prevent the uncontrolled movement of the air-borne particles of material from drifting around the ventilation curtain 64, a means is provided for inducing a flow of air transversely through the space 66. Additionally, a means is provided for withdrawing the air from one end of the space 66 to allow it to be discharged at an area remote from the face 26 of the mine and rearwardly of the machine 10. In ventilation system 62, this is accomplished by a ventilation fan 68 which is located at an end 70 of the curtain 64 to draw air from the space 66 to cause it to flow, as seen in FIG. 1, from the right side of the machine 10 to the left side 50 thereof. The ventilation fan 68 includes associated dust collecting means and an exhaust duct 72 to exhaust the ventilation air in a manner which is well-known in the mining art. If, for some reason, the ventilation fan 68 did not appear to produce a sufficient flow of air transversely through the space 66, an additional blower or other type of air flow producing means could be mounted on the right side of the machine 10 to induce sufficient air flow transversely through the space 66. Additionally, as seen in FIG. 2, the upper end 73 of the curtain 64 is capable of being selectively moved upwardly and downwardly in order for it to be located near the mine roof 34 as the drum head 14 is moved by its boom 18 for each new vertical cut into the face 26 of the mine 22.

Figure 3:
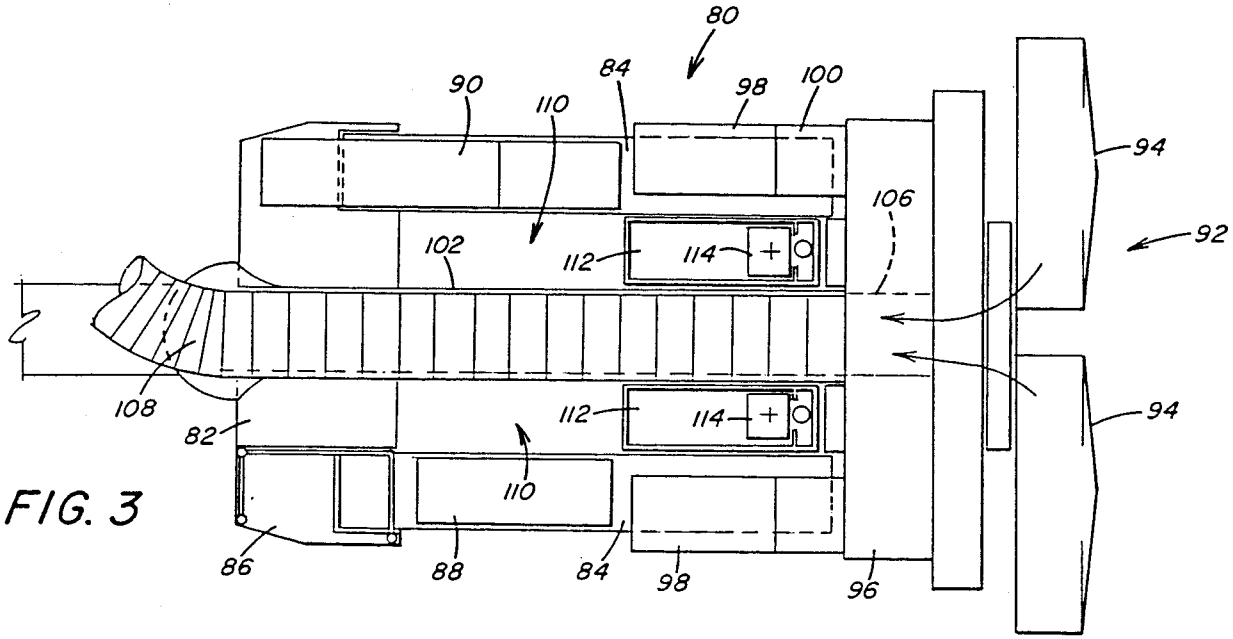
FIG. 3 is a top schematic view of another mining machine including an alternative embodiment of the invention.
Figure 4:
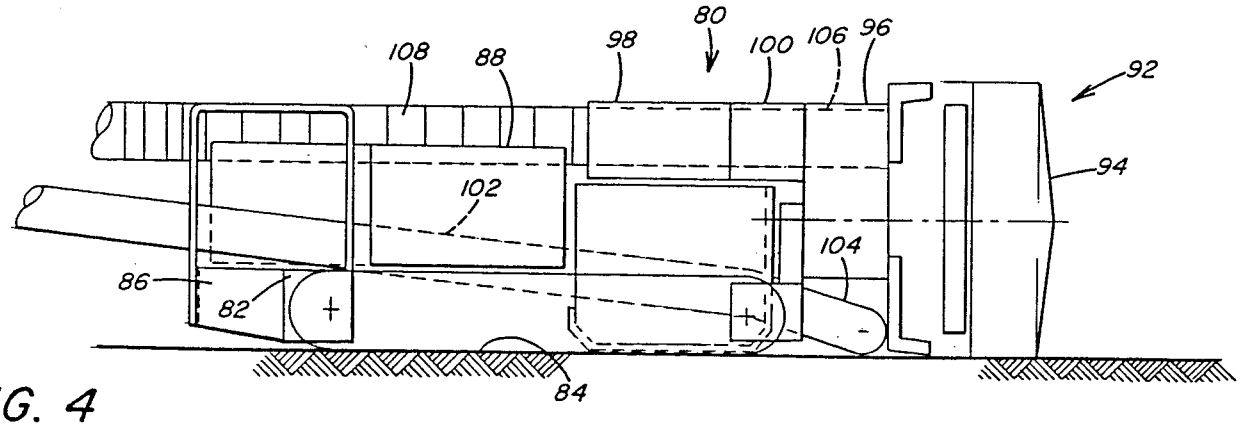
FIG. 4 is a side schematic view of the machine of FIG. 3.

As seen in FIGS. 3 and 4, an alternative mining machine 80 of the present invention includes a movable frame 82 which is propelled through a mine by a pair of ground engaging traction means 84. The machine 80 typically includes an operating station 86 for the control of the machine including an electrical system 88 and a hydraulic system 90. The alternative dislodging means for the machine 80 includes a boring head 92 having two counterrotating bores 94 of a conventional design. However, a main spur gear case 96 for the boring head 92 carries only the final reduction from the motor 98 and planetary primary drive 100 attached to each end of the gear case 96 above the ground engaging traction means 84. A longitudinally extending discharge conveyor 102 is located in the center of the machine 80 and is positioned near to the floor of the mine so that a forward end 104 thereof is capable of collecting the material dislodged by the bores 94. In order to provide ventilation near the dislodging means for removing air-borne particles from the air, an intake duct work 106 is provided through the main gear case 96 at the center of the machine 80 so that the exhaust tubing 108 thereof can be extending rearwardly over the longitudinal conveyor 102.

To provide the machine 80 with the desired means for installing roof bolts above the machine 80 during continued operation thereof, the frame 82 includes a pair of longintudinally extending vertical openings 110 which extend to the floor of the mine. Each of the openings 110 includes a drill pit 112 smaller than the drill pit 38 for the machine 10 since each of the vertical openings 110 is smaller than the opening 36. However, each of the drill pits 112 includes horizontal and longitudinal dimensions which are significantly less than the corresponding horizontal and longitudinal dimensions of its opening 110 in order to facilitate longitudinal relative movement of the drill pits 112 within the openings 110. Accordingly, the drill pits can again remain stationary for limited relative movement with respect to the frame 82 and the machine 80 as the machine 80 is propelled through the mine for continued mining operation. The preferred drill pits 112 are separate units which are located on opposite sides of the longitudinal axis of the machine 80. Each includes a bolter 114 and a temporary roof support means (not shown). With the temporary roof support means extended to make rigid contact between the floor and the roof of the mine, the bolter 114 can drill a hole for a roof bolt with a roof plate installed thereon.

Although, as seen in FIGS. 3 and 4, the preferred drill pits 112 include separate bases 116 which rest directly on the floor of the mine, it is possible for the bases 116 to be connected to form an interconnected single unit. In another words, although each of the openings 110 extends vertically through the entire machine 80, it is possible for a lower region of the openings 110 to be joined to provide a horizontal space extending across the machine to the outer edges of each of the openings 110. With such a configuration, the drill pits 112 will function in a manner similar to the single drill pit 38 of the machine 10. Well-known means in the mining art is again utilized to reposition the drill pits 112 forwardly within the openings 110 for the next installation after the roof bolts in a particular location are installed. The bolter modules for the drill pits 112 can alternatively include a completely automated bolter system rather than one which is manual.

Figure 5:
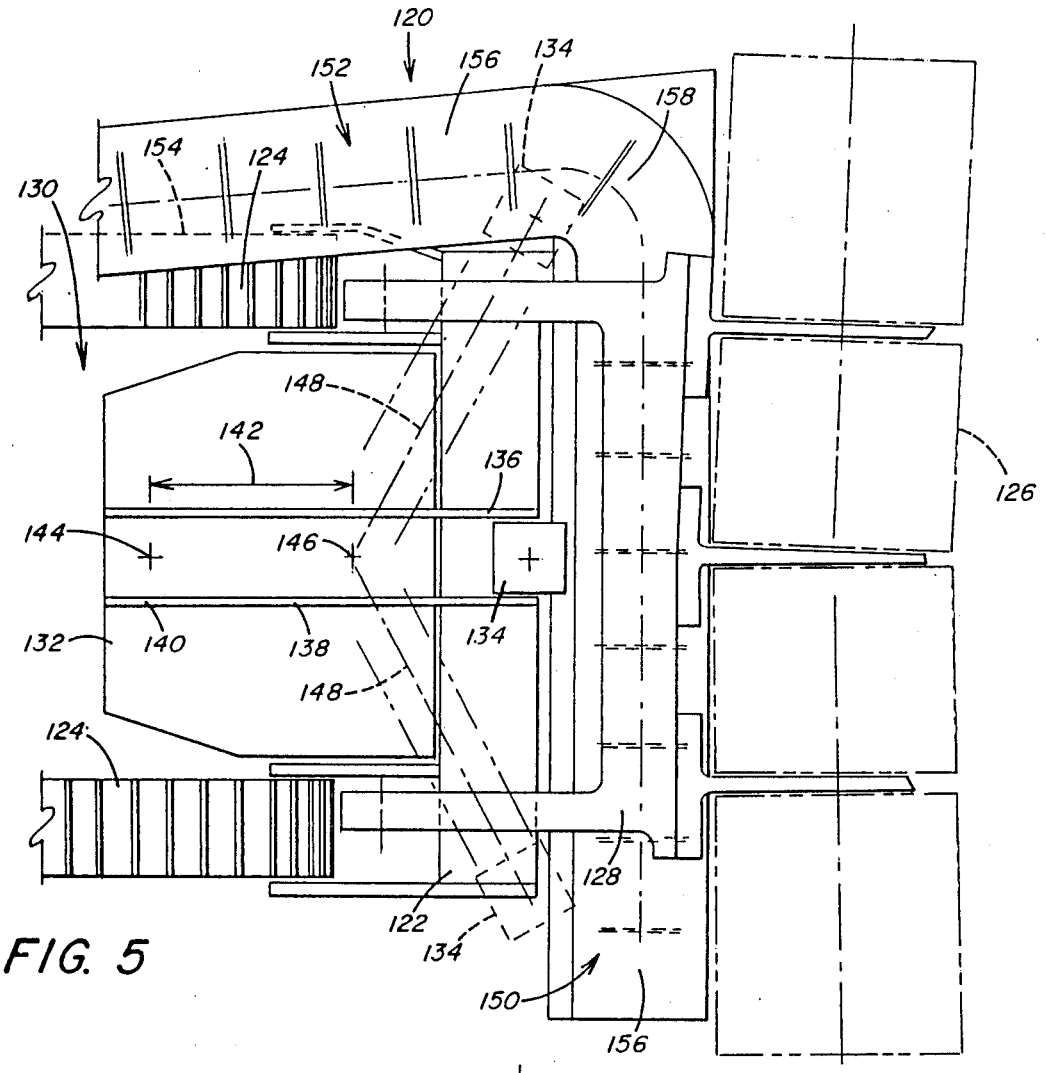
FIG. 5 is a fragmentary, top schematic view of the forward end of another continuous mining machine including still another alternative embodiment of the invention.
Figure 6:
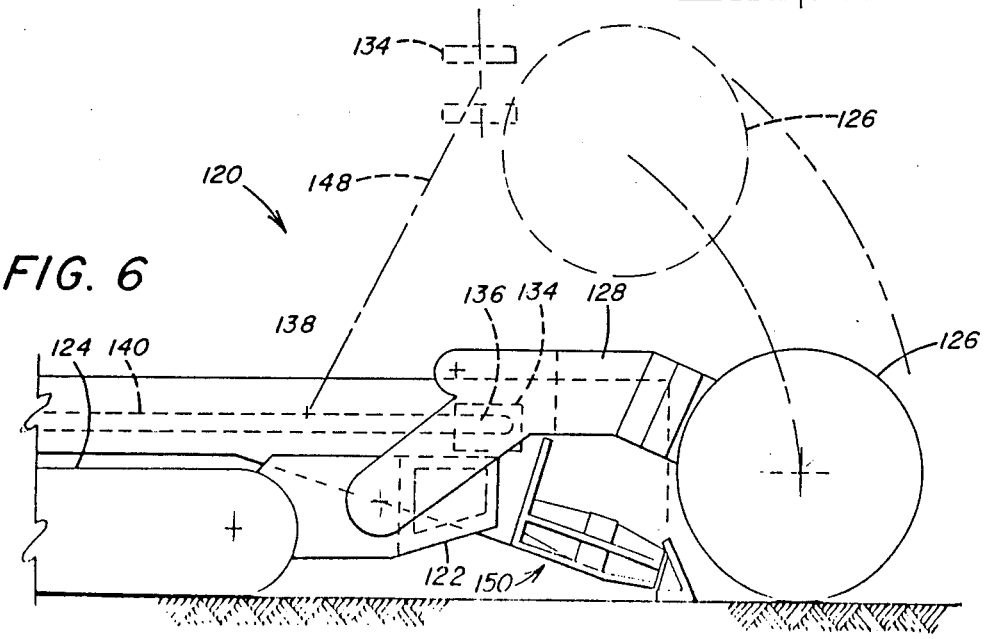
FIG. 6 is a side schematic view of the machine of FIG. 5.

As seen in FIGS. 5 and 6, another mining machine 120 includes a frame 122 and ground engaging traction means 124 for propelling the machine 120 through a mine to direct a dislodging means thereof to the face of the mine. The preferred dislodging means includes a drum type head 126 which is mounted on a movable boom 128. As the machine 120 is advanced by the ground engaging traction means 124, the drum head 126 is capable of dislodging material from the face of the mine as it is raised and lowered by the boom 128.

To provide the desired means for installing roof bolts above the machine 120, the machine 120 includes a vertically extending opening 130 in the center thereof which opening 130 again extends longitudinally of the machine 120 as did the opening 36 of machine 10. A different type of drill pit 132 is installed in the opening 130 to rest on the floor of the mine for longitudinal relative movement with respect to the frame 122 and the machine 120 as the machine continues advancing through the mine to dislodge material from the face thereof. As thus described, the drill pit 132 is similar in overall configuration and general operation to the drill pit 38 of the continuous mining machine 10. However, the drill pit 132 is utilized to support a bolter 134 which is mounted on the end 136 of an extensible boom 138. The other end 140 of the boom 138 is supported for pivotal, rotating movement on the drill pit 132. In addition to the extensible boom 138 being capable of pivoting on the drill pit 132, the end 140 of the boom 138 is also mounted for longitudinal relative movement between the end 140 of the boom 138 and the drill pit 132, As indicated by the arrow 142 in FIG. 5, the end 140 of the extensible boom 138 can be positioned at any location between a rearward location 144 and a forward location 146. Because of the pivotal mounting, the bolter 134 can be positioned toward either side of the machine 120. Additionally, because the mounting also allows relative longitudinal movement, the bolter 134 can be independently positioned longitudinally within the mine, as the drill pit 132 remains stationary, at a precise location relative to the roof of the mine for the installation of a bolt therein. Consequently, as seen by the alternative positions 148 of the center line of the boom 138, the bolter can be directed to install a wider array of bolts that could any of the embodiments discussed hereinabove. The array could include three, four or more roof bolts along a transverse line in the roof of the mine. It should be clear from the range of positions shown in FIG. 6 that the boom 138 can be directed to install roof bolts as close as practical to the face of the mine while allowing sufficient space for the operation of the drum head 126.

With the primary roof reinforcement being provided by the machine 120 and the drill pit 132 which is centrally positioned therein, there is again a need for efficiently collecting and transporting material which is dislodged by the drum head 126 to a location rearwardly of the machine 120. As mentioned above, many mining machines utilize a centrally located, longitudinally extending conveyor system. However, the alternative machine 120 first includes a transverse conveying means 150 mounted on the frame 122 rearwardly of and below the drum head 126 for gathering material dislodged thereby. There is also included a longitudinal conveying means 152 mounted on the frame 122 which extends from the transverse conveyor means 150 rearwardly of the machine 120 along a left side 154 thereof to transport the material to a location rearwardly of the machine 120. However, the transverse conveying means 150 and longitudinal conveying means 152 are not separate elements as they are in the preferred machine 10. The conveying means 150, 152 of the machine 120 are provided in the form of a "universal" endless chain conveyor 156 which includes a general right angle bend 158 at the left side 154 of the machine 120. The transverse leg of the endless chain conveyor 156 would collect material and transport it from the right side of the machine to the left side 154 of the machine 12, as seen in FIG. 5. When each flight of the endless chain conveyor 156 approaches the general right angle bend 158, it is redirected rearwardly to continue transportation of the material along the longitudinal leg of the conveyor 156 to discharge the material rearwardly of the machine 120 in a conventional manner.

Figure 7:
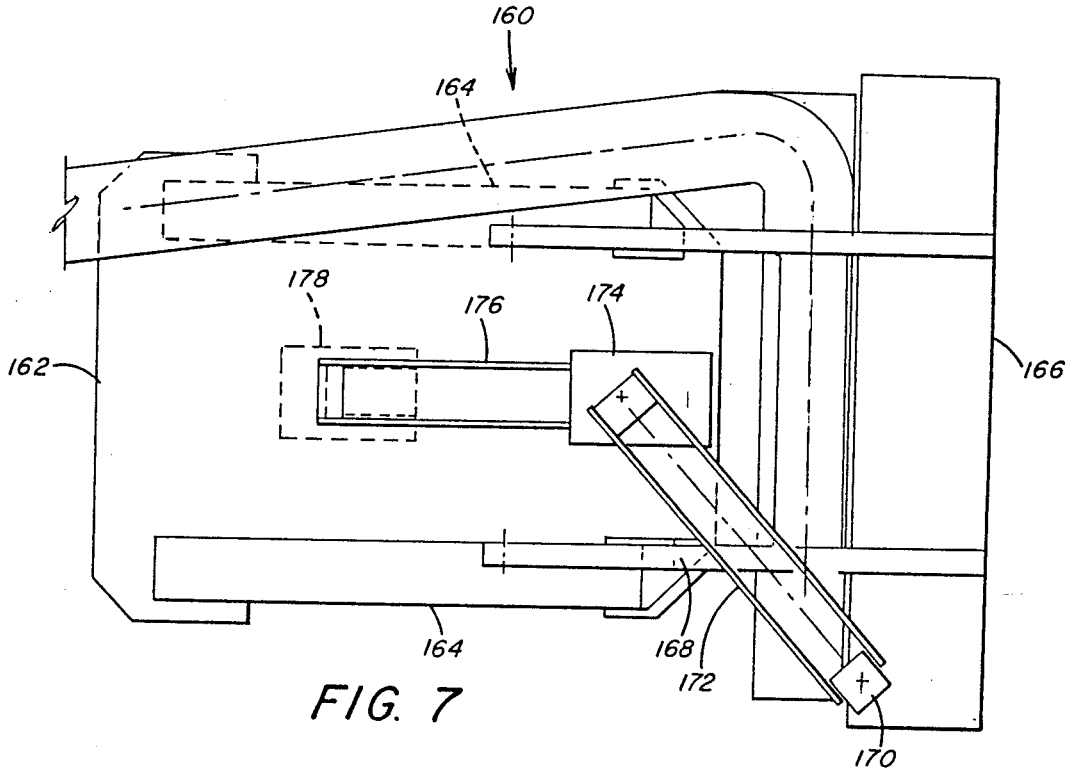
FIG. 7 is a top schematic view of still another mining machine including yet another alternative embodiment of the invention.
Figure 8:
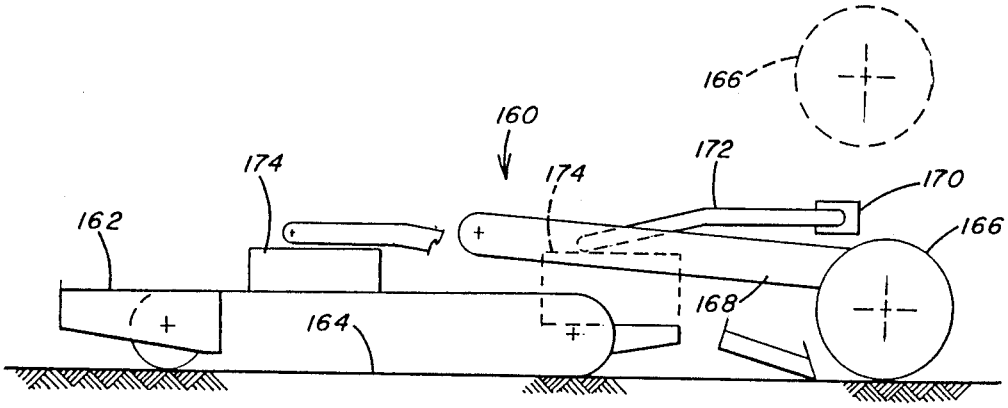
FIG. 8 is a side schematic view of the machine of FIG. 7.

As seen in FIGS. 7 and 8, still another mining machine 160 includes a frame 162 which is propelled by ground engaging traction means 164. A dislodging means in the form of a drum head 166 is mounted on the forward end of the frame 162 on a movable boom 168. To provide a means for installing roof bolts in the roof of the mine above the mining machine 160 during its continued operation, an alternative roof bolting means is provided in the form of a bolter 170 which is installed on the extended end of an extensible boom 172. As seen in FIG. 7, the extensible boom 172 is anchored for pivotal movement on a boom support 174 which is positioned forwardly on the machine 160. With the boom support 174 forwardly positioned, the boom 172 is rotated to locate the bolter 170 to the right or left side of the machine 162 above the lowered drum head 166.

In order to facilitate roof bolting as the mining machine 160 continues to advance, the boom support 174 is mounted on a longitudinally extending track configuration 176 centrally of the machine 160. The boom support 174 is capable of moving longitudinally on the track 176 for relative longitudinal movement with respect to the frame 162 and the machine 160. As a result, once the bolter 170 is properly positioned for the installation of a roof bolt, the machine 160 can continue to advance in a straight line as the boom support 174 remains relatively stationary with respect to the roof of the mine. The boom support 174 is capable of relative rearward movement on the machine 160 until it arrives at a rearward position indicated by the dotted line 178. Of course, the combination of relative longitudinal movement of the boom support 174 and the pivotal movement of the boom 172 allows the bolts to be installed in a transversely extending array across the roof of the mine as the mining machine 160 continues to advance the drum head 166 into the face of the mine. Again, as with the bolter 134 of the machine 120, the combined positioning of the boom 172 and the boom support 174 enables the roof bolts to be installed as close as practical to the face of the mine while allowing sufficient space for the operation of the drum head 166.

Accordingly, the mining machine 160 includes a configuration which does not require the roof bolting means to be supported on a drill pit or other apparatus which rest directly on the floor of the mine. On the other hand, the boom support 174 can be centrally located within the machine 160, since the mining machine 160 includes a material gathering configuration in the form of a transverse and longitudinal conveying means such as the endless conveyor 156 of the machine 120, as shown in FIGS. 5 and 6.

Although the roof bolting operation of the machine 120 of FIGS. 5 and 6 and the machine 160 of FIGS. 7 and 8 is preferably preformed as the machines are advancing, an important alternative operation should be discussed. Because the bolter is mounted on the end of an extensible boom and can be positioned above the lowered drum head, it is possible to install roof bolts extremely close to the face of the mine if the machine is stopped and the drum head lowered. Heretofore, if mine roof conditions required roof bolting very close to the mine face, the mining machine would only be operated to advance the drum head a few feet into the face. The mining machine would then be withdrawn from the face to allow portable roof bolters to be employed to install a transversely extending array of roof bolts at the mine face. Upon completion, the machine would again be returned to the mine face to advance the drum head only a few feet until it would have to be stopped and withdrawn for the installation of additional roof bolts.

However, with machines 120,160 the same array of roof bolts could be quickly installed without requiring the machine to be withdrawn from the face of the mine. Consequently, significant time, effort, and expense can be saved by the use of the bolters on the mining machines 120,160 even if the machines are not being operated to simultaneously advance the drum head when the roof bolts are being installed.

Figure 9:
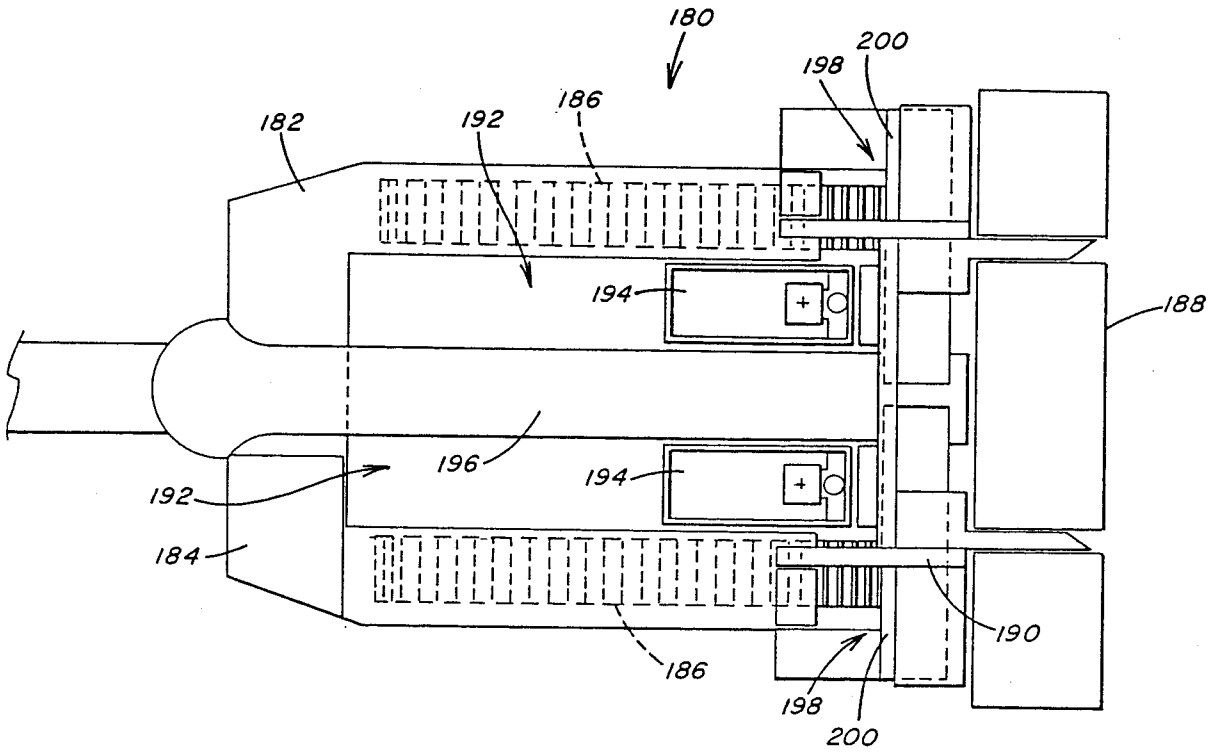
FIG. 9 is a top schematic view of yet another mining machine which includes one more alternative embodiment of the invention.

As seen in FIG. 9, yet another mining machine 180 includes a frame 182 which is operated from an operating station 184. The frame 182 is propelled by a pair of ground engaging traction means 186 to advance a drum type mining head 188 which is supported on a forward end of the frame by a boom 190. The machine 180 is similar to the machine 80 in FIGS. 3 and 4 since it includes a pair of vertical openings 192 which extend therethrough to the floor of the mine. Additionally, a pair of drill pits 194 are located in the openings 192 for relative longitudinal movement with respect to the machine 180 as it continues to advance through the mine. With the separate drill pits 194 and openings 192, the machine 180 is capable of utilizing a centrally located, longitudinally extending conveyor means 196 for the transportation of material dislodged by the drum head 188 to the rear of the machine 180. However, the machine 180 includes an alternative configuration for gathering and collecting material dislodged by the drum head 188 in the form of two transversely extending conveyor means 198. The preferred transverse conveyor means 198 are provided in the form of two endless mat chain or metal conveyor belts 200 which are located rearwardly of and below the drum head 188 in a position similar to that of the conveyor belt 54 of machine 10 as shown in FIGS. 1 and 2. However, each of the conveyor belts 200 is arranged to transport material from the side of the machine to the center thereof for transfer to the longitudinally extending chain conveyor 196. In other words, the material which is gathered on the upper conveying surface of each of the transverse conveyor belts 200 will be deposited between the flights of the longitudinal chain conveyor 196 for further transportion to a location rearwardly of the machine 180 in a conventional manner.

The various embodiments of the present invention illustrated in FIGS. 1–9 include numerous alternative means for providing roof bolts above a mining machine as the mining machine continues to advance through the mine to direct a dislodging means into the face of the mine. Although some of the machines are capable of only providing a limited array of such bolts in limited predetermined positions in the mine roof above the machine, it should be recognized that installing any bolts in this manner contributes to mine safety. For example, if it were to be determined that a particular array would not be satisfactory for continued operation of the mining machine without additional mine roof bolting or mine roof support, the limited number of bolts which are installed with some of the machines of the present invention provide roof support to protect the machine operating personnel until more extensive support is provided. On the other hand, some of the other machines of the present invention can clearly install a wide, transversely extending array of roof bolts which would tend to satisfy the requirements for permanent roof support. If, however, it were found that such a wide array of roof bolts could not be installed with sufficient speed to allow continuous mining, the machine might have to be temporarily halted until the array is completed installed. The machine would be able to continue its advancement through the mine as a new array is started. Such an operating procedure still provides needed protection for the mine operating personnel while being significantly faster and more economical than any system which requires the machine to be removed from the mine face in order to install roof support.

Figure 10:
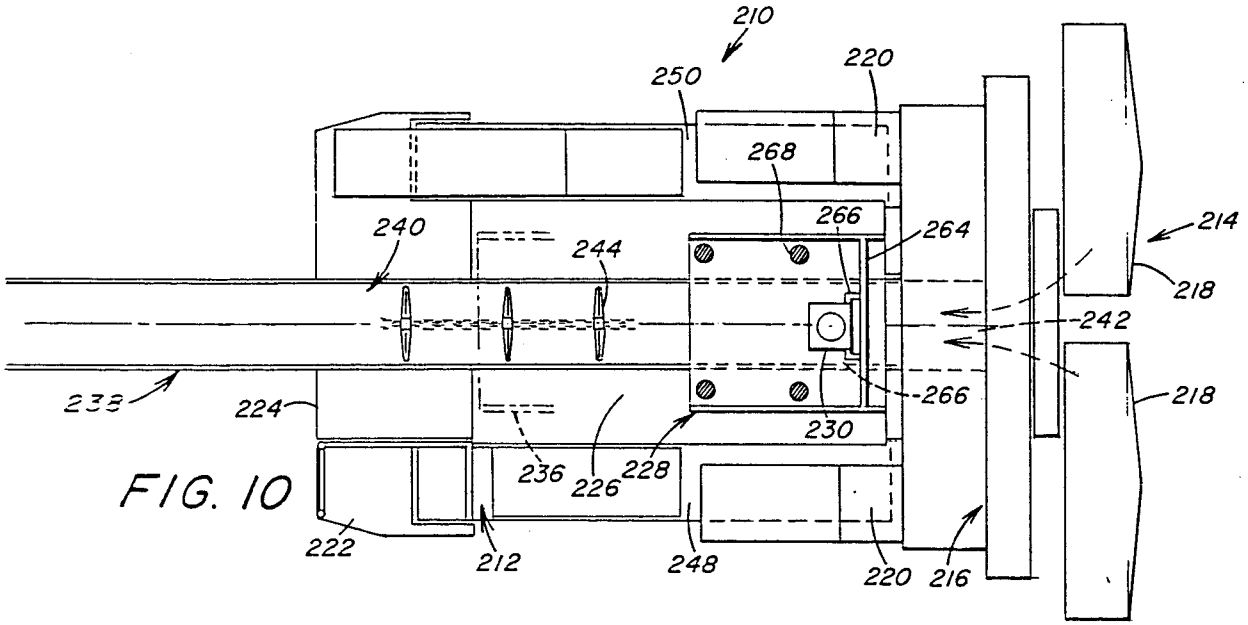
FIG. 10 is a top plan view of a mining machine including various features of the invention.

Referring to FIG. 10, there is illustrated a preferred mining machine generally designated by the numeral 210 which includes a frame 212 with a dislodging means generally designated by the numeral 214 mounted on a forward end 216 thereof. The dislodging means 214 includes two counterrotating bores 218 of conventional design.

Mining machine 210 includes ground engaging traction means 220 located at each side of frame 212 for propelling frame 212 and mining machine 210 within a mine along the mine floor to advance dislodging means 214 into a face to the mine to dislodge material therefrom.

Mining machine 210 is operated from operating station 222 to dislodge material from a mine face and to transport the dislodged material rearwardly of the rear end 224 of the machine 210. Accordingly, the mining machine 210 includes operating controls and sources of power for operating the ground engaging means 220, the pair of counterrotating bores 218 and other equipment which is well-known in the mining art.

Figure 11:
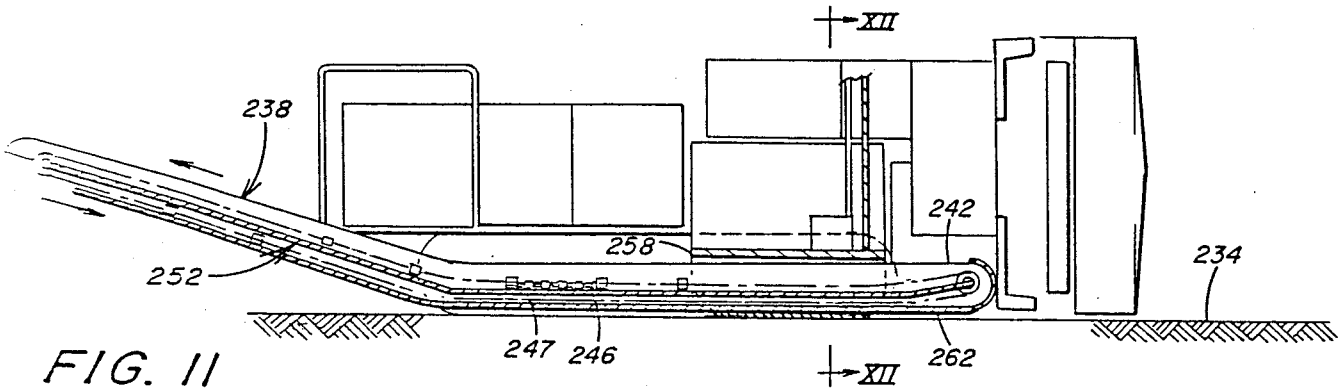
FIG. 11 is a side elevational view of the machine of FIG. 10 shown partially in section to better illustrate a longitudinal conveying system and a bolter pit.

In order to provide a preferred means for installing roof bolts at predetermined locations in a roof of the mine above the mining machine 210 as it continues to operate, the frame 212 is constructed in a manner to include a opening or receiver 226 in a central region thereof. The receiver 226 has a width which extends traversely of the machine 210 and a greater length which extends longitudinally of the machine 210. In the preferred machine 210, the means for installing roof bolts is provided by a movable bolter pit 228 which is located in the opening or receiver 226. Bolter pit 228 is slidably secured to frame 212. As will be explained later in greater detail, bolter pit 228 includes a bolter 230 positioned on transverse wall 258 as shown in FIG. 11. Although shown in a forward position, the bolter pit 228 rests on the mine floor 234 within the receiver 226 and is capable of moving longitudinally within receiver 226 relative to the frame 212 of the machine 210.

Bolter pit 228 has horizontal and longitudinal cross sectional dimensions which are respectively less than corresponding horizontal and longitudinal dimensions of the receiver 226 . With the bolter pit 228 properly positioned within opening or receiver 226, bolter 230 is in a position to drill a hole in the roof of the mine at each location where a roof bolt is to be installed. As holes are drilled in the mine roof, bolter 230 and bolter pit 228 are maintained in fixed position relative to frame 212 beneath the mine roof. It should be understood that bolter pit 228 may include either a bolter module having a completely automated bolter system or a manual system requiring an operator to install the bolts.

Since the bolter pin 228 is free to remain in a fixed position while installing roof bolts, the mining machine 210 is capable of continuing its advancement through the mine as it moves longitudinally relative to bolter pit 228. As seen in FIG. 10, with the horizontal and longitudinal dimensions of the bolter pit 228 being significantly less than those of receiver 226, bolter pit 228 is capable of longitudinal movement within receiver 226 with respect to frame 212 until the bolter pit 228 is positioned at the rear 236 of the receiver 226.

As seen in FIGS. 10 and 11, the mining machine 210 includes a conveying system generally designated by the numeral 238 which conveys material dislodged by counterrotating bores 218 to a location rearwardly of the machine 210. Conveying system 238 includes a conveying means 240 in the form of an endless mat chain or metal conveyor belt. Material dislodged by counterrotating bores 218 is directed to the forward end 242 of conveyor system 238 to allow endless conveyor belt 240 to transport the dislodged material longitudinally of machine 210 to deposit the material at a location rearwardly of the machine 210. The endless chain conveyor 240 includes a plurality of spaced flights 244 that run along the upper surface of longitudinally extending pan 246.

Conveyor system 238 includes a first portion 247 positioned substantially horizontally within frame 212 which extends longitudinally between frame 212 longitudinally extending side members 248 and 250. Conveying system 238 also includes a conveyor second portion 252 integral with and inclined to conveyor first portion 247 which extends rearwardly from rear end 224 of the machine 210. As described, the material dislodged by counterotating bores 218 is deposited on the forward end 242 of conveyor system 238 and transferred to the rear of machine 210 for disposition in a manner which is well-known in the mining art.

Figure 12:
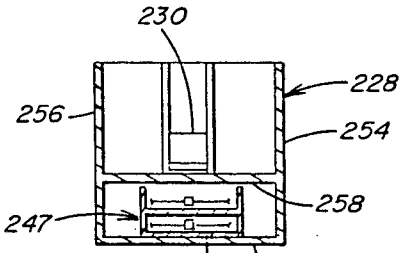
FIG. 12 is a view taken along line II—II in FIG. 11 illustrating a conveying system and a bolter pit.

As seen in FIG. 12, bolter pit 228 includes a pair of vertically extending plates or walls 254 and 256 which are maintained in spaced relationship by means of horizontally extending transverse wall 258. Bolter 230 is slidably secured to transverse wall or plate 258 in any suitable manner to permit bolter 230 to be positioned transversely at a preselected location along the top surface of wall 258.

Referring to FIG. 10, bolter pit 228 also includes vertically extending transverse plate 264. Bolter 230 is slidably secured to transverse plate 264 by means of guides 266. In this manner, bolter 230 is capable of vertical movement on transverse plate 264. Both bolter 230 and guides 266 are also capable of transverse movement along transverse plate 264.

As described, bolter 230 may be positioned transversely at a preselected location along the top surface of wall 258 and is movable vertically on plate 264 to permit selective positioning of bolter 230 on bolter pit 228 to install roof bolts in the mine roof in predetermined locations above mining machine 210.

As seen in FIG. 10, bolter pit 228 includes four posts 268 shown in section. The four posts 268 shown in section represent hydraulic or pneumatic piston cylinder assemblies which extend vertically from bolter pit 228 transverse wall 258. A canopy (not shown) is connected to the ends of the posts 268. Suitable hydraulic or pneumatic controls are operable to extend posts 268 from transverse wall 258 until the canopy contacts the surface of the mine roof. The canopy provides support to the mine roof and protection for the miner operating personnel while bolter 230 drills a hole in the mine roof and a roof bolt is inserted. After the roof bolt is inserted, cylinder rods 268 are retracted to remove the canopy from the mine roof.

Referring to FIG. 1, conveyor first portion 247 is positioned between horizontally extending transverse wall 258 and horizontally extending base wall 260 to allow conveyor first portion bottom plate 262 to rest on horizontally extending base wall 260. In this manner, as bolter pit 228 moves longitudinally within frame 212 receiver 226, a portion of conveyor first portion 247 is positioned on bolter pit 228 base wall 260. The conveyor system 238/bolter pit 228 arrangement illustrated in FIG. 10–12 eliminates the need for two separate bolter pits positioned on either side of longitudinally extending conveyor system 238.

According to the provisions of the patent statues, I have explained the principal preferred construction and mode of operation of my invention and have illustrated and described what I now consider to represent its best embodiments. However, it should be understood that, within the scope of the appended claims, the invention may be practices otherwise than is specifically illustrated and described.

I claim:

1. A mining machine for dislodging material from a vertical face comprising:

a frame;

roof bolting means movably mounted within said frame;

dislodging means mounted on one end of said frame;

propelling means for propelling said machine within a mine along the floor of said mine to advance said dislodging means into a face of said mine to dislodge material therefrom while actuating said roof bolting means to install roof bolts in the mine roof;

said roof bolting means arranged to remain in a stationary position and install roof bolts in the mine roof while said mining machine advances and dislodges material from the face;

transverse conveyor means mounted on said frame rearwardly of and below said dislodging means for gathering said material dislodged thereby; and longitudinal conveyor means mounted on said frame and extending from said transverse conveyor means rearwardly of said machine to receive said material from said transverse conveyor means and to transport said material to a location rearwardly of said machine.

2. A mining machine as set forth in claim 1, wherein said longitudinal conveyor means extends along one side of said machine.

3. The mining machine as set forth in claim 1, wherein said longitudinal conveyor means and said transverse conveyor means include an endless chain belt conveyor which makes a generally right angled bend at said one side of said machine.

4. The mining machine as set forth in claim 1, wherein said transverse conveyor means includes two transversely extending endless chain conveyors which respectively transport said material from a side of said machine to a center thereof and said longitudinal conveyor means includes a longitudinally extending endles chain conveyor which extends from said center to a rear end of said machine to receive said material from each of said transversely extending endless chain conveyors.

5. A mining machine as set forth in claim 1 which includes, ventilation curtain means extending vertically and transversely of said machine at a location rearwardly of said dislodging means to provide transverse space therebetween;

means for inducing a flow of air transversely through said space; and means for withdrawing said air from one end of said space to be discharged at an area remote from said face of said mine.

6. The mining machine as set forth in claim 5, wherein said means for withdrawing said air includes dust collecting means.

7. The mining machine as set forth in claim 5, wherein said means for withdrawing said air and said means for inducing said flow of said air are provided by a ventilation fan mounted on said frame rearwardly of said curtain means at one side thereof.

8. A mining machine for dislodging material from a vertical face comprising:

a frame;

roof bolting means movably mounted within said frame;

a pair of oppositely rotating boring heads mounted on one end of said frame;

propelling means for propelling said machine within a mine along the floor of said mine to advance said frame and said boring heads into a face of said mine to dislodge material therefrom while actuating said roof bolting means to install roof bolts in the mine roof;

said roof bolting means arranged to remain in a stationary position and install roof bolts in a mine roof while said mining machine advances and dislodges material from the face;

said boring heads arranged to deposit said material dislodged thereby centrally of said frame at said one end thereof; and a longitudinal conveyor means mounted on said frame and extending centrally through said machine and arranged to collect said material at said front end of said frame and transport said material to a location rearwardly of said machine.

9. A mining machine for dislodging material from a vertical face comprising:

a frame, said frame having a pair of spaced longitudinal side members;

dislodging means mounted on one end of said frame;

propelling means for propelling said machine within a mine along the floor of said mine to advance said dislodging means into a face of said mine to dislodge material therefrom;

roof bolting means for installing roof bolts at predetermined locations in a roof of said mine above said mining machine;

support means for supporting said roof bolting means, said supporting means positioned within said frame and movable relative to said frame;

said roof bolting means being arranged to remain in a stationary position and install said roof bolts at said predetermined locations above said mining machine and at a location between said frame member longitudinal side members while said mining machine including said frame member and said dislodging means of said mining machine are advancing into said face and dislodging said material from said face of said mine;

transverse conveyor means mounted on said frame rearwardly of and below said dislodging means for gathering said material dislodged thereby; and longitudinal conveyor means mounted on said frame and extending from said transverse conveyor means rearwardly of said machine to receive said material from said transverse conveyor means and to transport said material to a location rearwardly of said machine.

10. The mining machine as set forth in claim 9, wherein said longitudinal conveyor means extends along one side of said machine.

11. The mining machine as set forth in claim 9, wherein said propelling means includes ground engaging traction means at opposite sides of said frame and said support means is positioned between said ground engaging traction means.

12. A method of dislodging material from a vertical face comprising the steps of:

providing a mining machine having dislodging means mounted on one end thereof and a frame member, said frame member having a pair of spaced longitudinal side members;

propelling said mining machine within a mine along a floor of said mine to advance said dislodging means into a face of said mine to dislodge material therefrom; and maintaining a roof bolt means in fixed position and installing roof bolts in the roof of said mine above said mining machine at locations between said frame member longitudinal side members when said dislodging means of said mining machine is located at said face of said mine.

13. The method as set forth in claim 12, which includes installing a plurality of roof bolts at predetermined locations in said roof above said mining machine.

14. The method as set forth in claim 13, wherein said predetermined locations are above said dislodging means and adjacent said face of said mine.

15. The method as set forth in claim 14, including stopping said machine prior to said installing said plurality of said roof bolts.

* * * * *